US008839668B2

(12) United States Patent
Hemsing

(10) Patent No.: US 8,839,668 B2
(45) Date of Patent: Sep. 23, 2014

(54) AUTONOMOUS FORMATION PRESSURE TEST PROCESS FOR FORMATION EVALUATION TOOL

(75) Inventor: Jeffery James Hemsing, Humble, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 461 days.

(21) Appl. No.: 13/188,947

(22) Filed: Jul. 22, 2011

(65) Prior Publication Data

US 2013/0019672 A1 Jan. 24, 2013

(51) Int. Cl.
*E21B 49/08* (2006.01)
*E21B 49/00* (2006.01)

(52) U.S. Cl.
CPC ..... *E21B 49/008* (2013.01); *E21B 49/081* (2013.01)
USPC ..... 73/152.27

(58) Field of Classification Search
CPC ..... E21B 49/10; E21B 49/081
USPC ..... 73/152.22–152.24, 152.27, 152.21
See application file for complete search history.

(56) References Cited

U.S. PATENT DOCUMENTS 5,184,508 A * 2/1993 Desbrandes ..... 73/152.05
5,233,866 A * 8/1993 Desbrandes ..... 73/152.05
5,375,658 A * 12/1994 Schultz et al. ..... 166/250.01
5,703,286 A * 12/1997 Proett et al. ..... 73/152.05
5,947,213 A * 9/1999 Angle et al. ..... 175/24
6,296,056 B1 * 10/2001 Ward ..... 166/250.07
6,427,785 B2 * 8/2002 Ward ..... 175/48
6,609,568 B2 8/2003 Krueger et al.
6,832,515 B2 * 12/2004 Follini et al. ..... 73/152.02
6,843,317 B2 * 1/2005 Mackenzie ..... 166/254.2
6,932,167 B2 * 8/2005 Proett et al. ..... 175/50
7,011,155 B2 * 3/2006 Meister et al. ..... 166/250.01
7,024,930 B2 * 4/2006 Follini et al. ..... 73/152.02
7,117,734 B2 10/2006 Follini et al.
7,216,533 B2 * 5/2007 McGregor et al. ..... 73/152.27
7,266,983 B2 * 9/2007 Krueger et al. ..... 73/152.22
7,290,443 B2 11/2007 Follini et al.

(Continued)

FOREIGN PATENT DOCUMENTS

EP 1396607 A2 3/2004

OTHER PUBLICATIONS

International Search Report dated Sep. 3, 2012, received in corresponding UK Patent Application No. GB1210153.1.

*Primary Examiner* — John Fitzgerald
(74) *Attorney, Agent, or Firm* — Wong, Cabello, Lutsch, Rutherford, Brucculeri, LLP

(57) ABSTRACT

A formation tester places an isolation device, preferably a probe, in fluid communication with a formation to determine formation pressures. The tester's controller uses a pressure pre-test process to autonomously control operation. The controller measures drawdown pressure and interval as the tester draws down pressure in flowline coupled to the probe. If the drawdown pressure indicates a dry test has occurred, the process is aborted. Otherwise, the controller measures buildup pressure and interval by allowing buildup of pressure of the flowline. The controller permits this to continue until the interval is longer than the drawdown interval and/or until a rate of the buildup falls below a predetermined rate. If the buildup pressure is too tight relative to the drawdown pressure, the controller aborts the test. Eventually, the controller measures a final buildup pressure when the buildup terminates. A new drawdown rate and volume can be determined for subsequent formation tests.

36 Claims, 7 Drawing Sheets

(56) References Cited

U.S. PATENT DOCUMENTS

| | | | | |
|---|---|---|---|---|
| 7,331,223 | B2 | 2/2008 | Zazovsky | |
| 7,395,703 | B2 * | 7/2008 | Niemeyer et al. | 73/152.24 |
| 7,644,610 | B2 * | 1/2010 | Meister | 73/152.23 |
| 2004/0026125 | A1 | 2/2004 | Meister et al. | |
| 2004/0045706 | A1 | 3/2004 | Pop et al. | |
| 2004/0050153 | A1 * | 3/2004 | Krueger et al. | 73/152.22 |
| 2004/0231841 | A1 | 11/2004 | Niemeyer et al. | |
| 2005/0268709 | A1 * | 12/2005 | McGregor et al. | 73/152.27 |
| 2009/0049904 | A1 * | 2/2009 | Meister | 73/152.23 |
| 2009/0165548 | A1 * | 7/2009 | Pop et al. | 73/152.51 |
| 2009/0173538 | A1 * | 7/2009 | Estes et al. | 175/24 |
| 2009/0255731 | A1 | 10/2009 | Backhaus et al. | |

* cited by examiner

AUTONOMOUS FORMATION PRESSURE TEST PROCESS FOR FORMATION EVALUATION TOOL

BACKGROUND

Formation testing tools can measure formation pressures along a wellbore and can obtain formation fluid samples as well. Information from the pressures and samples can then help characterize the wellbore and can predict performance of the surrounding reservoirs. Formation testing tools can be conveyed downhole in a variety of ways, including wireline, drill string, or the like. In fact, formation testing tools disposed on drill collars of a drilling assembly evaluate newly drilled formations.

When used, the formation testing tool obtains formation pressures and reservoir fluids from desired locations or zones of interest in the wellbore. Because drilling mud is used during drilling, the formation testing tool first tests the obtained fluid to determine if it is free of mud filtrates. To do this, fluid samples can be directly analyzed with a variety of sensors, including optic devices, spectrometers, temperature sensors, pressure sensors, etc. Stored fluids can also be analyzed at the surface.

Tools, such as formation testing tools, used during drilling have limited capability to communicate with the surface. For this reason, controlling the tool by operators or surface equipment is often hindered by the lack of "real time" or limited communication between the downhole instrument and the surface. In the end, data quality may be compromised because of the inability to interact with the tool operation in a timely manner.

During a test operation, for example, pressure data collected on a drilling tool may not be communicated to the surface for multiple reasons, such as communication errors, poor signal to noise ratio, or by test design. Operators at the surface may not be able to monitor pressures in the tool's flowline in real time, and information from the drawdown and buildup of the pressure test cannot be viewed in real time at the surface. Thus, operators are unable to evaluate the quality of test measurements as they occur, and operators cannot abort a test or adjust the test's parameters during a formation test if needed.

Historically, operators have preprogrammed a fixed series of steps for the tool to perform. Once the tool is deployed, operators expect the tool to perform these steps as instructed. However, this procedure is neither efficient nor optimal due to the varying reservoir or formation properties. As long as the tool has sufficient processing capabilities, the downhole tool can use mathematical models to predict tool response and can then adjust operating parameters appropriately. Hence, there is a need for intelligent decision making in a downhole tool that replicates some of the decision-making capabilities that occur when an operator monitors and controls a formation tester in real time.

The subject matter of the present disclosure is directed to overcoming, or at least reducing the effects of, one or more of the problems set forth above.

SUMMARY

A formation tester or other downhole tool performs an autonomous pressure test (i.e., pre-test) operation using a local controller within the tool. The controller operates autonomously and uses automated decision-making to control the testing of formation pressures with a formation isolation device, such as a probe, straddle packer, or other known type of arrangement. To do this testing, the controller is preconfigured (programmed) to test each of one or more stations of a formation with the formation tester using at least two autonomous drawdowns and buildups.

During a first automated drawdown at a station of the formation, for example, the tool isolates a portion of the formation from the wellbore to obtain formation pressure and reservoir fluid therefrom. For example, the tool can dispose a probe against the formation to obtain formation pressure and reservoir fluid. The controller can determine that the probe is properly set by sensing a setting pressure of the hydraulic system used to set the probe.

With the isolation device set to obtain fluids from the formation, the controller measures the flowline pressure and the drawdown interval while the tool is performing the first autonomous drawdown with the flowline in fluid communication with the isolation device and the formation region of interest. The drawdown can be done using either a hydraulically activated or an electro-mechanical piston and pre-test chamber assembly, which is in fluid communication with the flowline.

If the flowline pressure response from the first drawdown fails to meet specified criterion, the controller then aborts this first autonomous drawdown and may attempt an entirely new operation or move on to another station.

Provided the first drawdown satisfies all the criteria, a buildup period commences in a first autonomous buildup. Thus, the focus of the disclosed tool is on obtaining a good steady state drawdown during testing, which is contrary to the exclusive focus on getting a good final buildup typically used by existing testing tools.

In the buildup period, the controller measures the flowline pressure and the elapsed time interval while allowing the buildup of pressure within the flowline. A buildup occurs when the drawdown piston has been stopped, and pressure in the flowline and pre-test chamber is allowed to increase, equilibrating with the formation pressure. During this first autonomous buildup, the controller permits the buildup to continue until a minimum set of criteria has been satisfied. For example, some possible criteria include, but are not limited to, the length of time and/or the rate of change in the buildup pressure. Thus, the controller can permit the buildup to continue until the buildup interval is longer than the drawdown interval and/or until the rate of pressure change falls below a predetermined threshold value. Otherwise, the controller aborts the first autonomous buildup if at least one of the specified buildup criteria has not been attained.

Finally, the controller determines if another buildup period is required and determines a new drawdown rate and a new drawdown volume for subsequent, autonomous drawdown and buildup operations. These second autonomous drawdowns and buildups are performed as before. At the end of the second autonomous buildup, the controller compares the first buildup pressure to a second buildup pressure measured in the second autonomous buildup. Based on the comparison, the controller decides how to proceed with operations of the formation tester. If the first and second buildup pressures are the same or close to one another, the controller can reset for new operations at another station of the formation. If the buildup pressures are different (at least within a threshold), then the controller can perform third drawdown and buildup to obtain more drawdown and build up pressures to clarify any discrepancies in data.

The foregoing summary is not intended to summarize each potential embodiment or every aspect of the present disclosure.

DETAILED DESCRIPTION

A. Formation Testing Tool

Figure 1A:
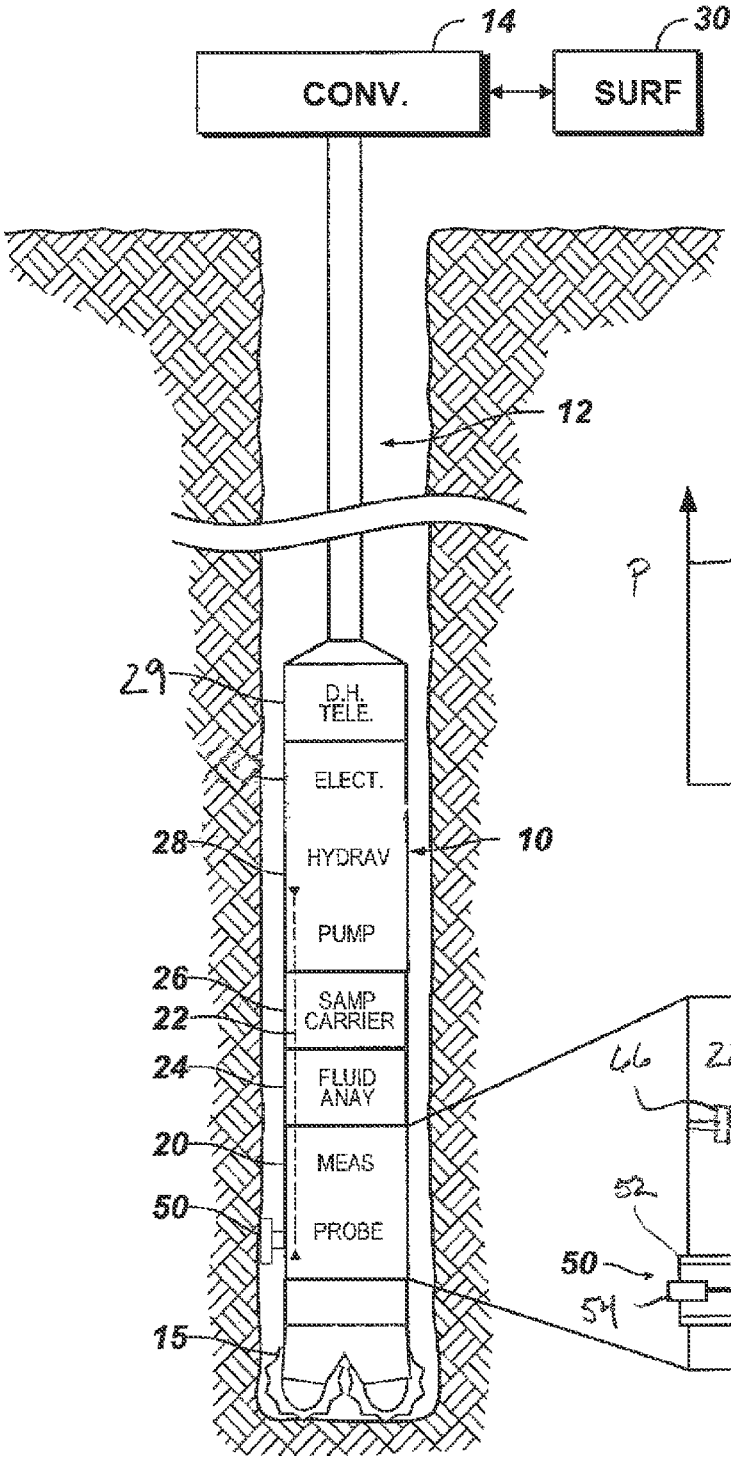
FIG. 1A shows a formation tester tool according to the present disclosure on a drill string.

In FIG. 1A, a conveyance apparatus 14 at the surface deploys a tool 10 downhole using a drill string, a tubular, a cable, a wireline, or other component 12. The tool 10 can be any tool used for wireline formation testing, production logging, Logging While Drilling/Measurement While Drilling (LWD/MWD), or other operations. For example, the tool 10 as shown in FIG. 1A can be part of an early evaluation system disposed on a drill collar of a bottomhole assembly having a drill bit 15 and other necessary components. In this way, the tool 10 can analyze the formation pressures and reservoir fluids shortly after the borehole has been drilled.

Figure 1B:
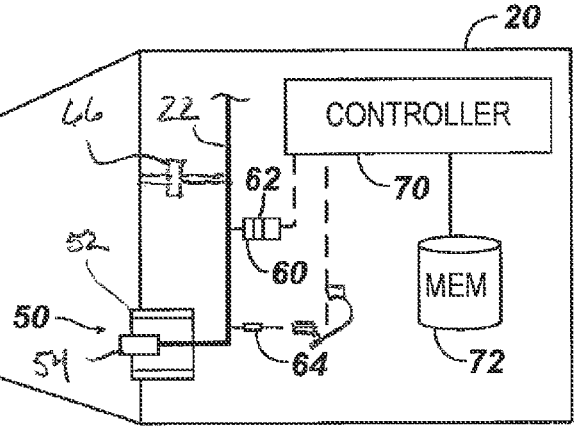
FIG. 1B shows a detail of the formation tester tool having an isolation device, an equalization valve, a drawdown piston, a controller, and transducers.

In use, the tool 10 obtains data at various depths in the borehole to determine various characteristics of interest, such as formation pressures in various zones. To do this, the tool 10 has an isolation device 20 and other components for in-situ sampling and analysis of formation fluids in the borehole. Details of the device 20 are schematically shown in FIG. 1B. The objective is for the tool 10 to obtain accurate pressure measurements at various stations (depths) in the borehole without specific consideration to the actual fluid makeup.

In the present example, the isolation device 20 has a probe 50, which can include an isolation piston 52 and snorkel 54. In alternative arrangements, the isolation device 20 can use a straddle packer or other suitable arrangement known in the art to isolate portion of the borehole wall to obtain formation fluids through a port or the like on the tool 10.

A flowline 22 of the tool 10 communicates with this isolation device's probe 50 and extends through various sections of the tool 10 as shown in FIG. 1A (dashed line). In general, these sections can include a fluid analysis section 24, a sample carrier section 26, hydraulic-pump-electronics section 28, and a telemetry section 29, although the tool 10 can have any number of suitable components often used in formation testing tools. Section 26 has sample carriers for fluid, while section 28 has hydraulic system and pump components for operating components of the tool 10. In addition, this section 28 has electronics for power distribution within the tool 10 and for receipt of power from the surface or from a local power source (not shown). The telemetry section 29 can use mud pulse, wired pipe, electromagnetic, and other types of telemetry known and used in the art.

At the isolation device 20, a drawdown chamber 60 and piston 62 connect to the flowline 22, and an equalization valve 66 communicates between the flowline 22 and the surrounding borehole annulus. Various sensors 64 connect to the controller 70 for monitoring parameters of the sampled fluid, including pressure, temperature, flow rate, and the like. Suitable sensors 64 include crystal quartz gauges, strain gauges, resistivity cells, and other temperature and pressure transducers. Data from the sensors 64 can be recorded in a local memory unit 72.

During operation, the tool 10 disposes at a desired location in the borehole. When the equalization valve 66 of the tool 10 opens to equalize pressure in the tool's flowline 22 with the hydrostatic pressure of the fluid in the wellbore, one or more of the sensors 64, such as a pressure transducer or gauge, is able to measure the hydrostatic pressure of the fluid in the wellbore.

Commencing test operations, the area of the formation (i.e., a station in the wellbore) to be sampled is isolated from the borehole by straddle packers, an elastomeric pad, a metal pad, an isolation piston, or the like to make a seal against the formation and the mud cake. For example, the probe 50 can use its isolation element 52 and snorkel 54 that extend from the tool 10 to establish fluid communication with the formation. The equalization valve 66 then closes to isolate the tool 10 from the wellbore fluids. As the probe 50 then seals with the formation to establish fluid communication, pressure measured by the sensors 64 reach a point 42 depicted in the graph of FIG. 2.

At this stage, the tool 10 draws formation fluid into the tool 10 by retracting the drawdown piston 62 in a chamber 60. This creates a pressure drop in the flowline 22, which most likely will be below the formation pressure. The volume expansion is referred to as "drawdown" and permits reservoir fluid to flow into the low-pressure region created by the retracting of the drawdown piston. The "drawdown" has characteristic shapes that those skilled in the art can use to infer reservoir properties. As shown in the graph of FIG. 2, for example, the drawdown 43 continues with pressure dropping as the volume in the pre-test chamber 60 increases.

Preferably, the drawdown is mechanically actuated, which generally allows the drawdown to have a more consistent rate of activation. However, other forms of actuation can be used for the drawdown. In fact, the drawdown can be hydraulically actuated. Although this may vary the drawdown rate, the processing and analysis disclosed herein can accommodate a varying rate for the drawdown.

Eventually, the piston 62 in FIG. 1B stops retracting, and fluid from the formation continues to enter the probe 50. Given a sufficient amount of time, the pressure builds up in the flowline 22 until the pressure in the flowline 22 has reached equilibrium with the formation pressure. The final build-up pressure measured by the pressure transducer of the sensors 64 is referred to as the "sandface" pressure and is assumed to approximate the formation pressure.

Figure 2:
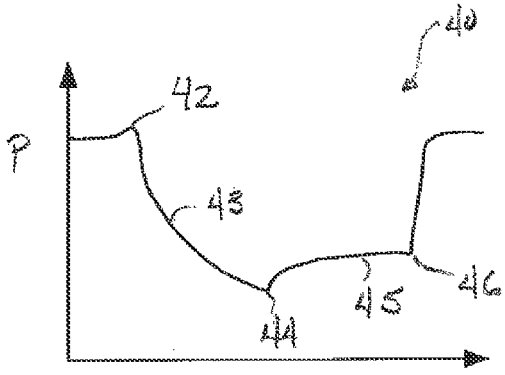
FIG. 2 graphs typical pressures during drawdown and buildup cycles.

As shown in the graph of FIG. 2, for example, the drawdown by the piston (62) stops at point 44. As fluid continues to enter the probe (50), the pressure buildup 45 increases until the pressure in the flowline (22) is the same as the pressure in the formation. This final or sandface pressure 46 is then assumed to approximate the formation pressure, which can be used to characterize the borehole, pressure gradient, etc. Although not shown, determining the formation pressure with the probe 50 can use a number of successive drawdowns and buildups to determine the validity of the final formation pressure.

Depending on the circumstances, collected data can be communicated or telemetered uphole by telemetry components 29 on the tool 10 for processing by surface equipment 30. Alternatively, the collected data can be processed locally by the downhole controller 70. Either of these scenarios is applicable to the disclosed tool 10. Although only schematically represented, it will be appreciated that the controller 70 and surface equipment 30 can employ any suitable processor, program instructions, memory, and the like for achieving the purposes disclosed herein.

Because the intention is to analyze formation fluids and formation pressures, obtaining uncontaminated fluids with the probe 50 is of prime importance. In some instances, the fluid can be contaminated by drilling fluids because the probe 50 has made a poor seal with the borehole wall or because of some other reason. Consequently, the drawn fluid can contain hydrocarbon components (solid, liquid, and/or gas) from the formation as well as drilling mud filtrate or other contaminants. For this reason, the drawn fluid can flow through the tool's flowline 22, and various instruments and sensors in the tool 10 can analyze the fluid to determine when the drawn fluid is primarily formation fluids.

For example, the isolation device 20 can uses its sensors 64 to measure various physical parameters (i.e., pressure, temperature, viscosity, density, etc.) of the fluid, and a measurement device, such as a spectrometer, a resistivity cell, a capacitance cell, or the like, in the fluid analysis section 24 can determine physical and chemical properties of oil, water, and gas constituents of the fluid. Eventually, fluid directed via the flowline 22 can either be purged to the wellbore or can be directed to the sample carrier section 26 where the samples can be retained for additional analysis at the surface. Eventually, the probe 50 can be disengaged, and the tool 10 can be positioned at a different depth (i.e., another station) to repeat the test cycle.

Overall, the tool 10 can test several stations of the borehole by repeating the testing operations and altering parameters in the process. The first test at the first station can use drawdown rates and other parameters based on known characteristics of the wellbore. Then, as testing continues at other stations, the various rates and other parameters from previous tests can be used, and new rates and parameters can be calculated as discussed below. Depending on communications, the tool 10 can receive parameters (e.g., drawdown rates, buildup times, buildup volumes, etc.) for use at a given station and can send data uphole to the surface.

Overall, the tool 10 can draw in about 3 cc to about 13 cc during each test. The pretest chamber 60 can hold up to 40-47 cc during the multiple tests at a test station downhole. Before being moved to a new station downhole, the entire chamber 60 of the tool 10 can be flushed and reset to accept an entirely new test volume. Of course, the chamber 60 can be flushed between any given pre-test at the same station if desired.

B. Pressure Test Process for Formation Pressures

1. Overview

When obtaining fluid samples and pressures of the formation with the tool 10 of FIGS. 1A-1B disposed on the drilling assembly 15, operators may wish to circulate drilling mud in the wellbore through the drilling assembly 15 to avoid problems with the assembly 15 sticking in the borehole or the like. Conversely, the operators may not wish to circulate because of other components in the Bottom Hole Assembly (BHA) or other concerns so that communication from the surface with the tool 10 can be limited in such circumstances. Likewise, formation testing via wireline may also have some disadvantages due to communication challenges between operators at the surface and the tool 10 disposed in the wellbore.

In the case of limited communication with the surface equipment 30, an operator has the ability to let the controller 70 operate in an autonomous mode where any decision about the next step in the operation of the tool 10 is determined by the controller 70. In this way, there is no need for instantaneous communication to the surface, which may not be possible or may be problematic or insufficient for testing purposes as noted previously. Operating in this "autonomous" mode allows the tool 10 to obtain high quality data and allows the tool 10 to operate without human intervention. The tool 10 only needs to communicate points of interest from the test and the current status of the tool 10 to the surface equipment 30 once the operation has been completed.

To operate the tool in the "autonomous" mode, the tool's controller 70 is programmed with a formation pressure test ("pre-test") process for controlling drawdown and buildup operations. In the pre-test process, the programmed controller 70 can make decisions using direct measurements during downhole operations. As detailed later, these direct measurements include pressure, temperature, fluid flow rate, drawdown volume, time intervals, and the like and are made with the various sensors 64 and other components of the tool 10. Incorporating these direct measurements, the controller 70 can determine optimal operational parameters given current conditions encountered downhole.

In general, the pre-test process relies on the fundamental relationships between fluid flow and porous media to optimize the tool's operation as much as possible. In turn, the controller 70 controls the testing sequence of the formation testing tool's probe 50 by using the measured values and performing calculations as data is being acquired. Starting with some initial set conditions, the controller 70 then works to optimize pre-test operations by incorporating the primary measurements from the downhole tool 10 to make operational decisions and adjust operating parameters. In this way, problems associated with mathematical transforms and the like for process control can be avoided.

The decisions and controls of the pre-test process are intended to replicate as closely as possible the decisions typically made by a human operator if the human operator were able to operate the downhole tool 10 remotely with instantaneous communications. After starting the test with a set of preprogrammed values, the controller 70 measures the response. The controller 70 then makes a decision based on programmed logic and determines subsequent settings and actions. The process continues until the given time expires or some other occurrence terminates the process. Particular details of the pre-test workflow of the controller 70 are discussed below with reference to FIGS. 3-8.

2. Stages of the Pressure Test Process

Figure 3:
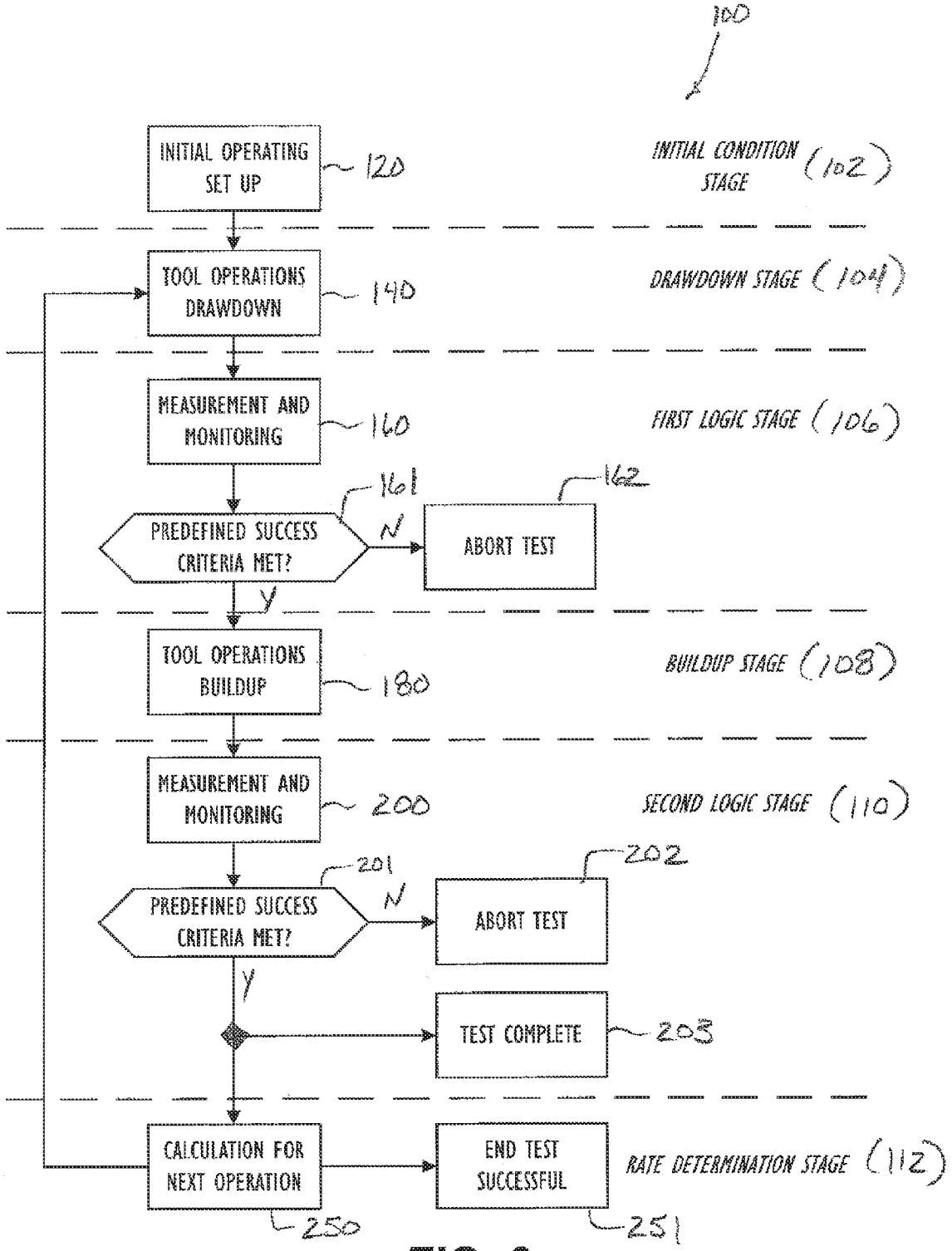
FIG. 3 shows a pressure test process according to the present disclosure in flow chart form.

Referring to FIG. 3, a pre-test process 100 of the present disclosure is shown in flowchart form. (In the following discussion, reference to elements in FIGS. 1A-1B and 2 are concurrently made.) The process 100 includes a series of stages, including an initial condition stage (102), an autonomous drawdown stage (104), a first logic stage (106), an autonomous buildup stage (108), a second logic stage (110), and a rate determination stage (112).

The stages (102 through 112) follow in succession of one another to complete the pre-test process 100. Typically, the process 100 repeats at the same location (station) in the borehole by making several drawdown and buildup sequences through the stages (104 through 112). During pressure acquisition, however, the process 100 will make at least two autonomous drawdowns and buildups, looping through stages (104 through 112) twice and terminating if the same result is produced both times. Being autonomous, the drawdowns and buildups with their associated logic stages are intended to operate in isolation of communication or instruction from surface equipment and users. Other implementations may use more or less drawdown and buildup sequences depending on the circumstances.

In the initial condition stage (102), the process 100 performs initial operating set up (Block 120) by configuring all of the required initial operating parameters for the tool 10 to perform a pre-test. These initial operating parameters can be configured prior to deployment downhole or can be communicated from the surface to the tool's downhole telemetry system during deployment.

Once initial setup is complete, the tool 10 commences the drawdown stage (104) in which the tool 10 performs its drawdown operations (Block 140). To do this, the tool 10 of FIGS. 1A-1B can use its probe 50 and the procedures outlined previously, although other isolation devices and methods to isolate portion of a formation and obtain formation fluids therefrom could be used as also outlined previously. As part of setting the probe 50, the tool 10 can monitor how much hydraulic pressure is applied to the probe 50 to set it (and its pad if present) against the formation. Feedback from a pressure transducer in the hydraulics used to extend the probe 50 can indicate this setting pressure (and hence, the force that the probe 50 is exerting against the formation). If the pressure is insufficient or beyond a maximum threshold, the controller 70 can assume that a suitable seal with the formation has not been achieved by the probe 50. In such an instance, the controller 70 can abort the test and attempt to set again.

Once the probe 50 or other isolation device is properly set, the tool 10 performs the drawdown. During this procedure, the controller 70 is simultaneously executing the first logic stage (106) by performing measurement and monitoring (Block 160). The controller 70 analyzes the results to determine whether measurements made during the drawdown meet the predefined criteria that indicate a successful drawdown (Decision 161). In general, the pre-test process 100 aborts any operation that does not meet required criteria and may send a failure code to the surface. As discussed in more detail later, the basis for the decisions about whether a given drawdown meets the required criteria involve questions such as whether the drawdown volume is too small, whether the time interval for drawdown to occur is too long, whether the pressure difference created during drawdown is too small, whether the last recorded pressure after drawdown is above the fluid's expected bubble point pressure, and the like. If one or more of the required criterion is not met, the pre-test process 100 terminates as the tool 10 aborts the test and the human operator is informed of the test result or the decision is stored in the on-board memory 72 for surface retrieval (Block 162).

If the measurement and monitoring of the drawdown indicates success, the pre-test process 100 proceeds to the buildup stage (108) in which the tool 10 performs its buildup operations (Block 180). As noted previously, the tool 10 performs a buildup by stopping the motion of the drawdown piston 62 and allowing pressure to increase in the flowline 22 as outlined previously.

With the buildup, the controller 70 simultaneously executes the second logic stage (110) by performing measurement and monitoring (Block 200). Here, the controller 70 again analyzes the results to determine whether predefined required criteria are met that indicate a successful buildup (Decision 201). As discussed in more detail later, the basis for the decisions about whether a given buildup meets the required criteria involve questions such as whether the time interval for buildup to occur is long enough, whether the pressure difference created during buildup is too small, whether the last recorded pressure after buildup is below a minimum threshold, whether the buildup rate is too slow, whether too many buildup attempts have been made, and the like. If the criteria are not met, the pre-test process 100 terminates as the tool 10 aborts the test (Block 202). Otherwise, the pre-test process 100 results in a completed test (Block 203). The human operator is informed of the test result, or it is stored in the on-board memory 72 for surface retrieval.

With a completed drawdown and buildup sequence, the pre-test process 100 may also calculate new variables for the subsequent operation of the tool 10 (Block 250) in the rate determination stage (112), which is described in more detail later. If the required criteria are met, the successful test then ends (Block 251), and the calculations for the next operation can be stored for later retrieval by the controller 70 when executing the next drawdown operation.

Given the general overview of the stages of the pre-test process 100 in FIG. 3, the various stages of the pre-test process 100 are discussed in more detail below with reference to FIGS. 4 through 8.

a. Initial Condition and Drawdown Stages

Figure 4:
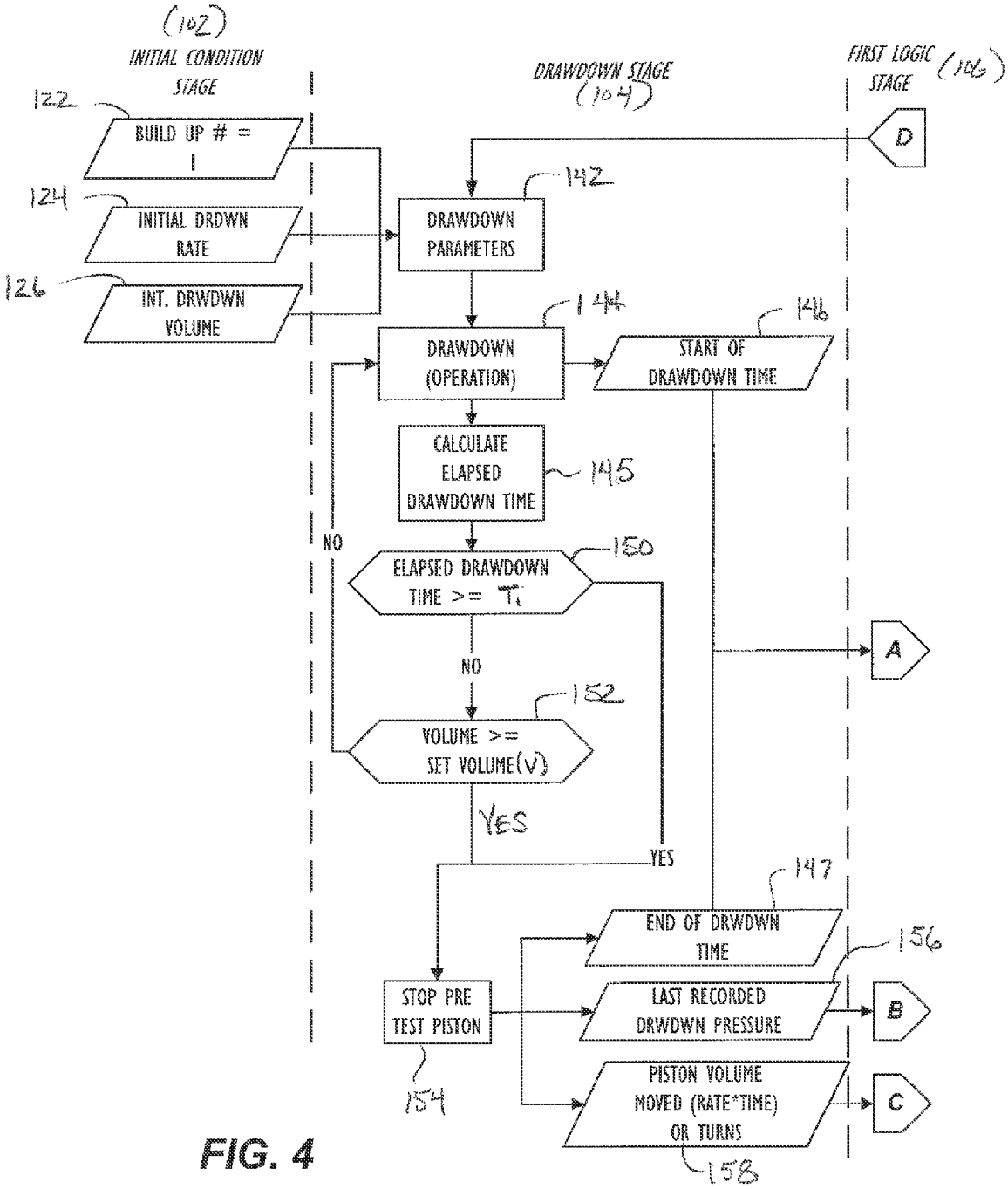
FIG. 4 shows details of the initial condition and drawdown stages of the disclosed process of FIG. 3.
Figure 5:
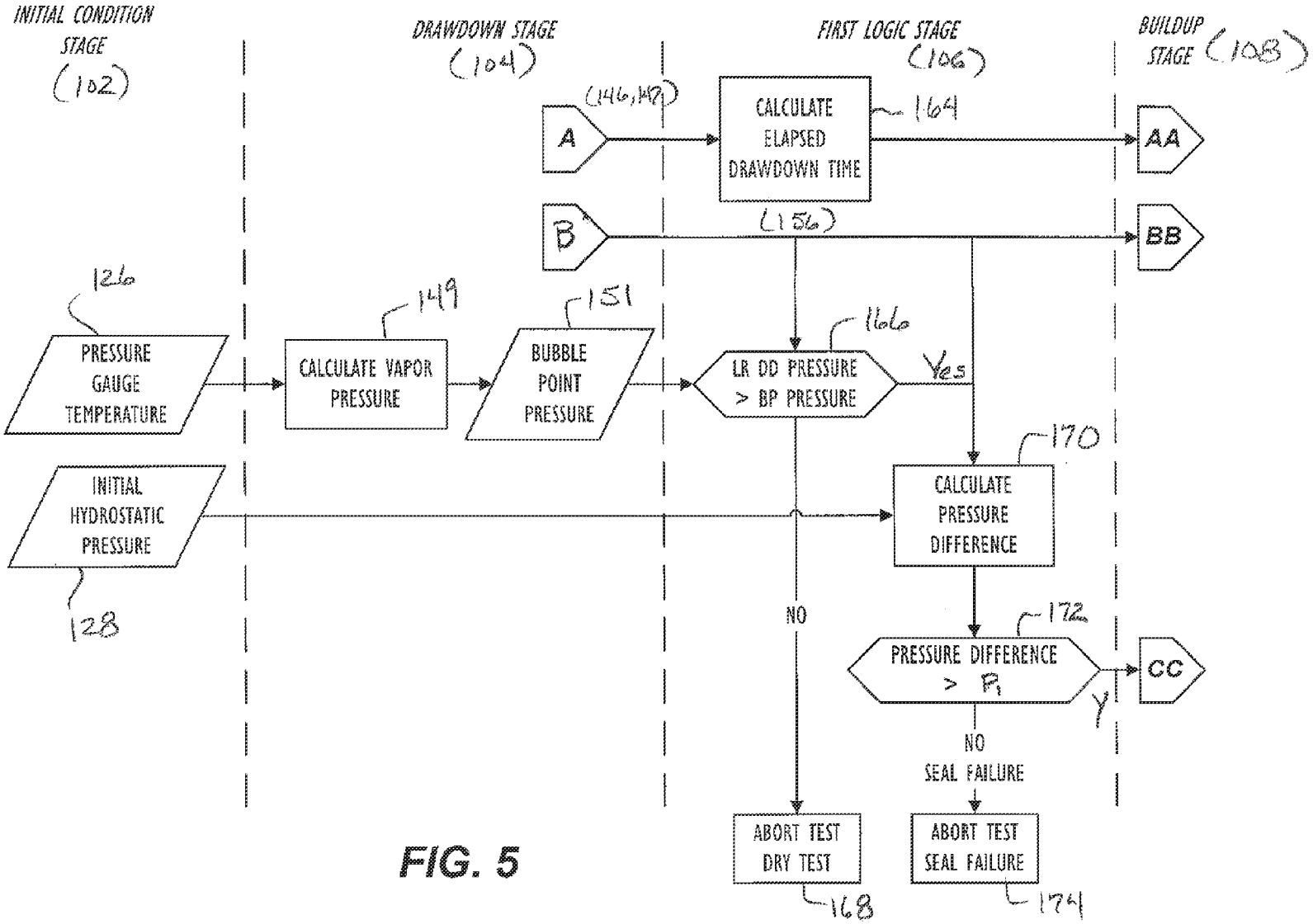
FIG. 5 shows details of the initial condition, drawdown, and first logic stages of the disclosed process of FIG. 3.

FIG. 4 shows portions of the initial condition stage (102) and the drawdown stage (104). (Additional details of these stages are illustrated in FIG. 5). As shown in FIG. 4, some of the initial conditions for the drawdown stage (104) include a buildup count 122, an initial drawdown rate 124, and an initial drawdown volume 126. These conditions are initially set by operators a priori, either during tool rig up for operations or through proprietary downhole communication schema. The buildup count 122 would be initialized when the sequence is started. The initial drawdown rate and volume 124/126 are based on expected characteristics of the formation under investigation, characteristics of the zone to be tested, a priori knowledge, and other variables known to those skilled in the art.

These initial conditions 122/124/126 are stored locally in the controller (70) and fed into the drawdown stage (104) as drawdown parameters 142 during use of the tool (10). As the pre-test process 100 then initiates the drawdown operation of the tool 10 (Block 144), the initial drawdown parameters 142 are used to control the operation. As the drawdown occurs, the controller (70) stores a start time of the drawdown 146 for processing in the first logic stage (106) of FIG. 5 via Link (A). The controller (70) also calculates the elapsed drawdown time or interval (Block 145).

If the elapsed time during a drawdown is less than a predefined time $T_1$ (Decision 150), the process 100 continues the drawdown and checks if the volume V of drawdown fluid from the formation is greater than or equal to a predefined volume set for operation (Decision 152). To check the drawdown volume, the controller (70) determines the volume of the drawdown chamber (60) based on the movement of the drawdown piston (62), for example, and techniques known in the art. (The predefined time $T_1$ and volume V depend on the implementation and can vary.)

If either enough time has elapsed or enough volume has been achieved, the process 100 stops the drawdown piston (62) of the tool (10) for the pre-test (Block 154). Stopping of the drawdown piston (62) signals the end of the drawdown period and signals the start of the buildup period. The start 146 and end 147 of the drawdown interval are then stored for later processing in the first logic stage (106) of FIG. 5 via Link (A). Likewise, the last recorded drawdown pressure 156 is stored for later processing in the second logic stage (110) of FIG. 7 via Link (B), and the volume 158 that the drawdown piston (62) has moved is stored for later processing in the rate determination stage (112) of FIG. 8 via Link (C). As noted previously, the controller (70) of the tool (10) obtains this data with the various sensors (64) and other components so that data can be stored locally in memory (72).

Turning to FIG. 5, additional portions of the initial condition stage (102) and the drawdown stage (104) are shown. Here, initial conditions for the drawdown stage (104) also include the pressure gauge temperature 126 and initial hydrostatic pressure 128 obtained with sensors (64 or others) of the tool (10). During drawdown, the pre-test process 100 calculates a vapor pressure (Block 149) based on known empirical relationships between pressure and temperature 126. This vapor pressure 149 is then used to estimate a bubble point pressure 151. Determining the bubble point is based on an assumption that the drawdown fluid volume includes some combination of mud filtrate and formation fluids. The calculated bubble point pressure 151 is fed to the first logic stage (106) as discussed below.

b. First Logic Stage

In addition to portions of the initial condition and drawdown stages (102 and 104), FIG. 5 also shows the first logic stage (106) having data fed thereto and relaying data to the buildup stage (108). With the drawdown, this first logic stage (106) as shown in FIG. 5 performs some analysis on the data. In particular, the first logic stage (106) obtains the start and end times (146, 147) of the drawdown operation (Link A) and calculates the elapsed drawdown interval (Block 164), which is used in later processing in the second logic stage (110) of FIG. 7 via Link (AA).

More importantly, the first logic stage (106) also obtains the bubble point pressure 151 and initial hydrostatic pressure 128 from prior to the drawdown operation. Using these previously measured pressures, the first logic stage (106) analyzes whether the pre-test should be aborted. One possible reason for aborting the test is if a drawdown was "dry" (i.e., the drawdown had little or no fluid volume) (Block 168). In other words, the fluid in the flowline can no longer be treated as a single-phase solution, which compromises any analysis methodologies. Another reason for aborting the test is if the tool's seal failed during drawdown (Block 174). In other words, the probe (50) on the tool (10) may have allowed borehole fluids to enter the tool's flowline (22), compromising the test results.

A "dry" test as used herein may refer to a drawdown that results in little or no fluid volume. This can be different from a "tight" test, in which little or no build-up is measured after drawdown. To determine if the test was "dry," the first logic stage (106) determines whether the last recorded drawdown pressure 156 via Link (B) is greater than the bubble point pressure 151 (Decision 166). If not, then the pre-test 100 is aborted because the test had a dry drawdown (Block 168). In other words, little or no formation fluid volume was obtained in the drawdown so that the results are not useful.

If the last recorded drawdown pressure 156 is greater than the bubble point pressure 151 (Decision 166), the first logic stage (106) calculates their pressure difference (Block 170) and determines whether the difference is greater than some predefined pressure differential $P_1$ (Decision 172). (The actual predefined differential $P_1$ used can depend on the particular implementation and expected values and may be configurable during operation either automatically or remotely.) If the pressure differential is not great enough, the first logic stage (106) determines that the seal of the probe (50) has failed and aborts the pre-test (Block 174). If there is enough pressure differential, then the first logic stage (106) stores a positive indication for the buildup stage (108) of FIG. 6 via Link (CC).

c. Buildup Stage

Figure 6:
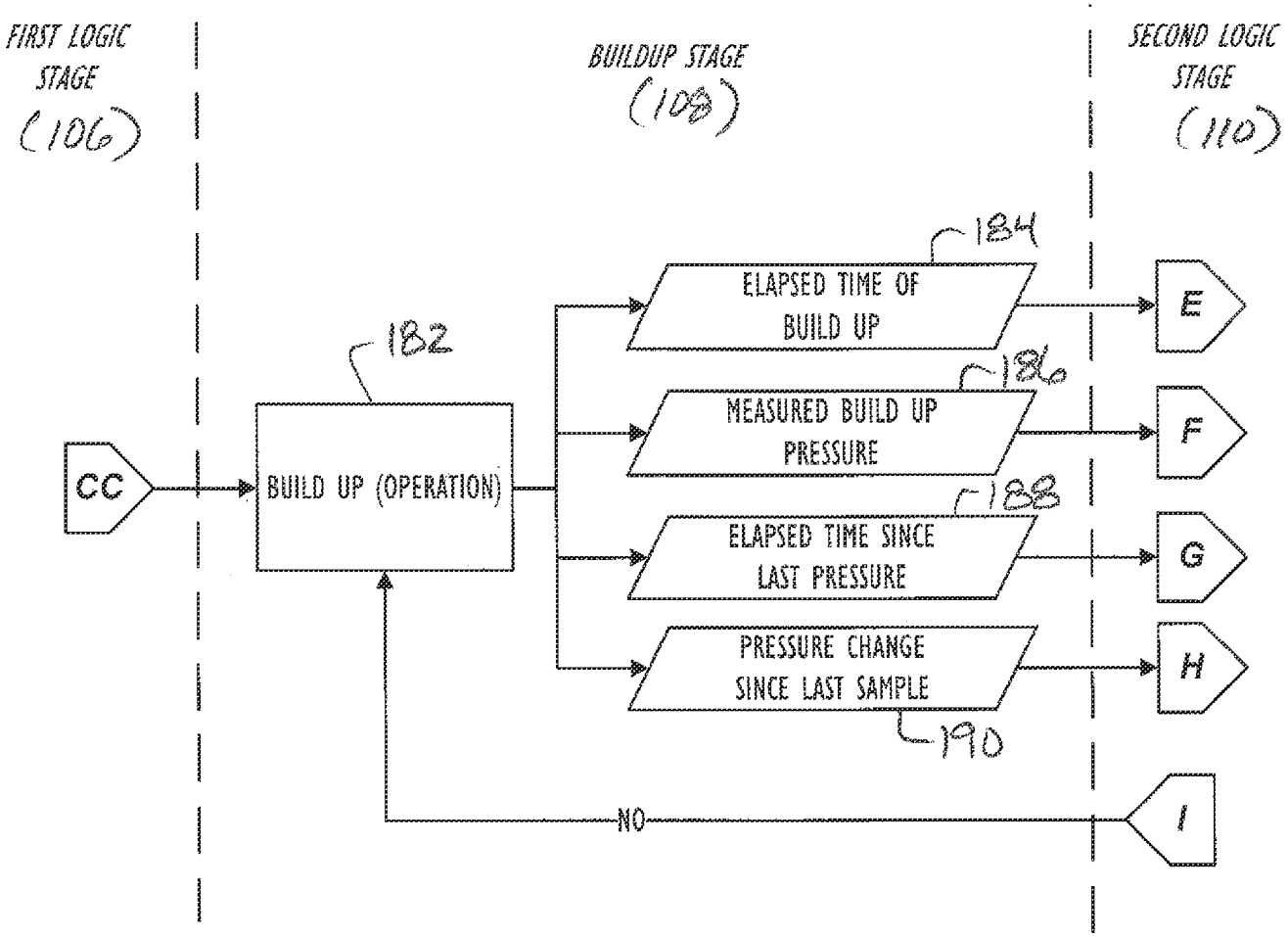
FIG. 6 shows details of the buildup stage of the disclosed pre-test process of FIG. 3.

With the successful drawdown stage (104) completed (i.e., the pre-test process 100 has not aborted either due to mechanical failure (seal failure) or over stressing the formation (dry tests), the pre-test process 100 commences the buildup stage (108) as shown in FIG. 6. In this stage (108), the pre-test process 100 commences the buildup operation (Block 182) of the tool 10. During this operation as noted previously, the tool (10) stops the drawdown of the piston (62) and allows the formation fluid entering the flowline (22) to equalize the pressure between the tool (10) and the formation. The fluid entering through the probe (50) into the flowline (22) will increase and fill the drawdown chamber (60). Feedback from the second logic stage (110) via Link (I) that the buildup operation has reached a sufficient length of time can then be used to control operation. Details of this feedback are provided later.

The buildup operation (Block 182) produces a number of variables for later processing. In particular, the process 100 determines an elapsed time 184 of the buildup, a measured buildup pressure 186, elapsed time 188 since the last pressure measurement, and a pressure change 190 since the last pressure sample by the appropriate sensor. Each of these variables can be obtained with the tool's controller (70), associated timers, and sensors (64) as discussed previously. Once obtained, these variables (184, 186, 188, and 190) are used for the second logic stage (110) of FIG. 7 via Links E-H.

d. Second Logic Stage

Figure 7:
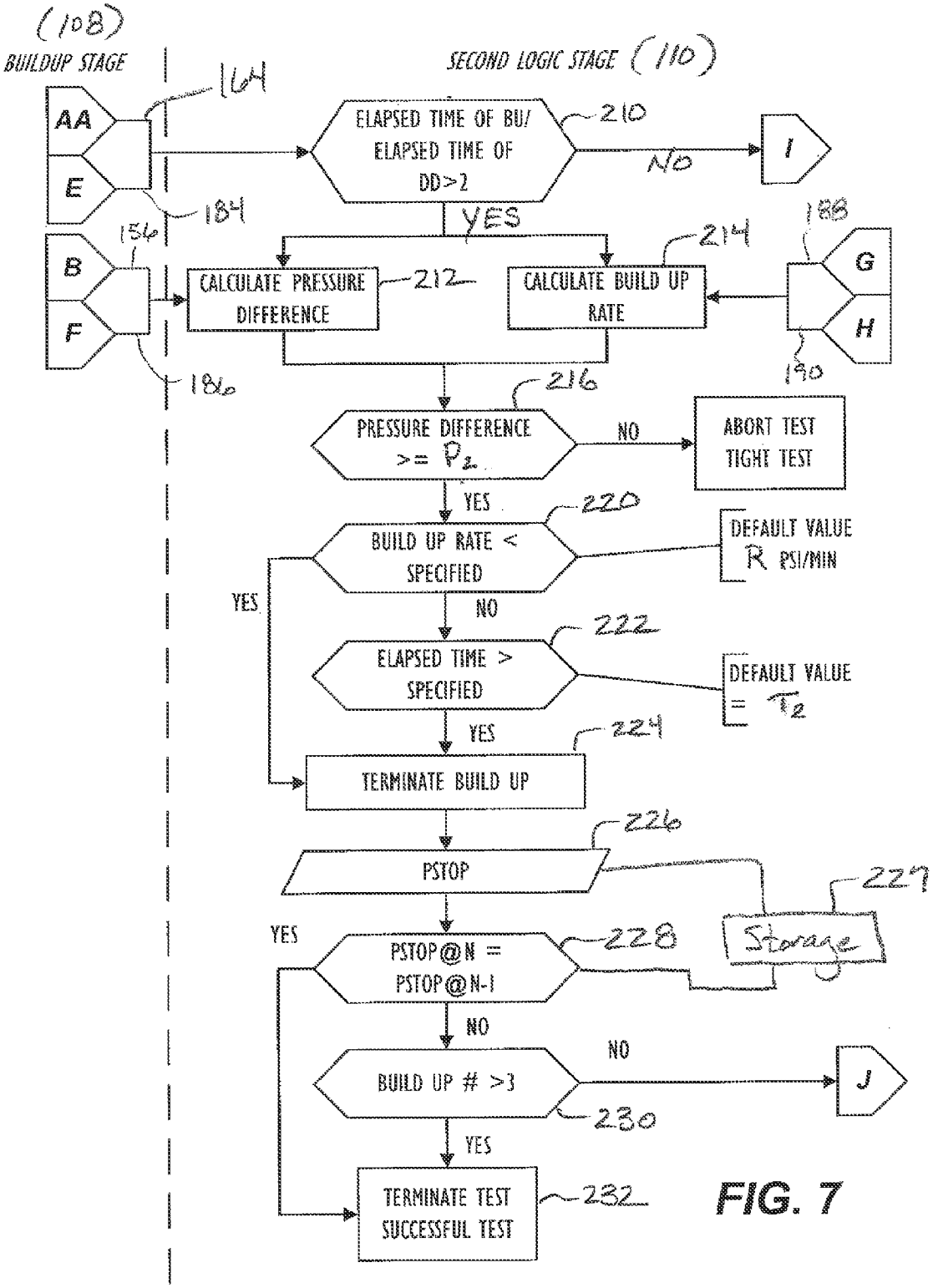
FIG. 7 shows details of the second logic stage of the disclosed process of FIG. 3.

FIG. 7 shows the second logic stage (110) of the pre-test process 100, which is performed with and after the buildup stage (106). As noted previously, the second logic stage (110) gives feedback to control the buildup operation. To do this, the second logic stage (110) determines whether the elapsed time 164 (Link AA) of the buildup is twice as great as the elapsed time 184 (Link E) of the previous drawdown (Decision 210). If not, then the buildup operation is allowed to continue, and the process 100 returns this indication as feedback (Link I) to the buildup operation (182) in FIG. 6. This length of elapsed time may be preferred in some implementations, but could differ.

If enough time has elapsed at decision 210, then the second logic stage (110) calculates a pressure difference 212 between the last recorded drawdown pressure 156 (Link B) and the measured buildup pressure 186 (Link F). The second logic stage (110) also calculates the buildup rate 214 using the elapsed time 188 (Link G) since the last pressure and the pressure change 190 (Link H) since the last pressure sample, as obtained from the buildup stage (108) of FIG. 6.

At this point, the second logic stage (110) of FIG. 7 makes a number of comparisons to determine whether to abort the pre-test, continue buildup, or stop buildup. In particular, the second logic stage (110) takes the pressure difference 212 between the last recorded drawdown pressure and the measured buildup pressure and determines whether the difference 212 is greater or equal to a predefined pressure difference $P_2$ (Decision 216). (The actual predefined difference $P_2$ can depend on the implementation and may be configurable during operation either automatically or remotely.)

If the difference 212 is not sufficient, then the second logic stage (110) aborts the pre-test for being "tight." In other words, the pre-test operation in this instance would have a thin pressure differential, indicating that the buildup has produced an increase in pressure that is only slightly over the original drawdown pressure, which could occur due to any number of reasons.

If the difference 212 is sufficient, the second logic stage (110) determines whether the buildup rate 214 is less than a specified rate R (Decision 220). (The actual specified rate R can depend on the implementation and may be configurable during operation either automatically or remotely.) In general, it is desirable to end the buildup period when the rate of change of the pressure during the buildup period has decreased indicating that a stable sandface pressure has been reached.

Additionally, the second logic stage (110) determines whether the elapsed time 184 (Link AA) for the buildup has exceeded a specified time $T_2$ (Decision 222). (The actual specified time $T_2$ can depend on the implementation and may be configurable during operation either automatically or remotely.) Although not shown, the pre-test process 100 may allow additional time to elapse if the Decision at 222 indicates that the elapsed time is not long enough.

In the end, the second logic stage (110) terminates the buildup and obtains a final pressure measure ($P_{STOP}$) 226 and is stored (Block 227). As intended, this final buildup pressure ($P_{STOP}$) 226 corresponds to the sandface pressure (46) in FIG. 2 indicative of the formation pressure, although it actually may not depending on the circumstances. The controller (70) obtains the final buildup pressure from the last pre-test in storage (Block 227) and compares it to the final buildup pressure ($P_{STOP}$) 226 for this pre-test (Decision 228). If this is the first drawdown and buildup with the tool 10 at the current location in the formation, then the process 100 will repeat at least once more by continuing to (Decision 230), discussed later.

If this is the second drawdown and buildup with the tool 10 at the current location in the formation, then the process 100 may or may not repeat another drawdown and buildup sequence. In particular, if the current buildup pressure ($P_{STOP}$) 226 is the same (or at least within some acceptable error) as the previous buildup from storage (Decision 228), then the current pre-test terminates as successful (Block 232). If the two buildup pressures from the current and previous test are not the same, the second logic stage (110) determines if this current buildup is the last of the three allotted operations (Decision 230) and successfully terminates the test if so (Block 232). Otherwise, whether this is the first pre-test run or the second run not matching the pressure of the first, the pre-test process 100 continues onto the rate determination stage (112) of FIG. 8 via Link (J).

As noted previously, the pre-test process 100 typically cycles no more than three times in its present configuration. After the first pre-test, a second pre-test may be needed with adjusted rate and volume. Yet, the process 100 stops short of doing a third pre-test if the second pre-test process 100 results in the same final buildup pressure ($P_{STOP}$) 226 as the first pre-test. Other implementations may involve more or less repetitions of the drawdown and buildup at the same borehole location. It is possible that the counter can be configured to contain as many iterations of drawdown and build up sequences as feasible.

e. Rate Determination Stage

Figure 8:
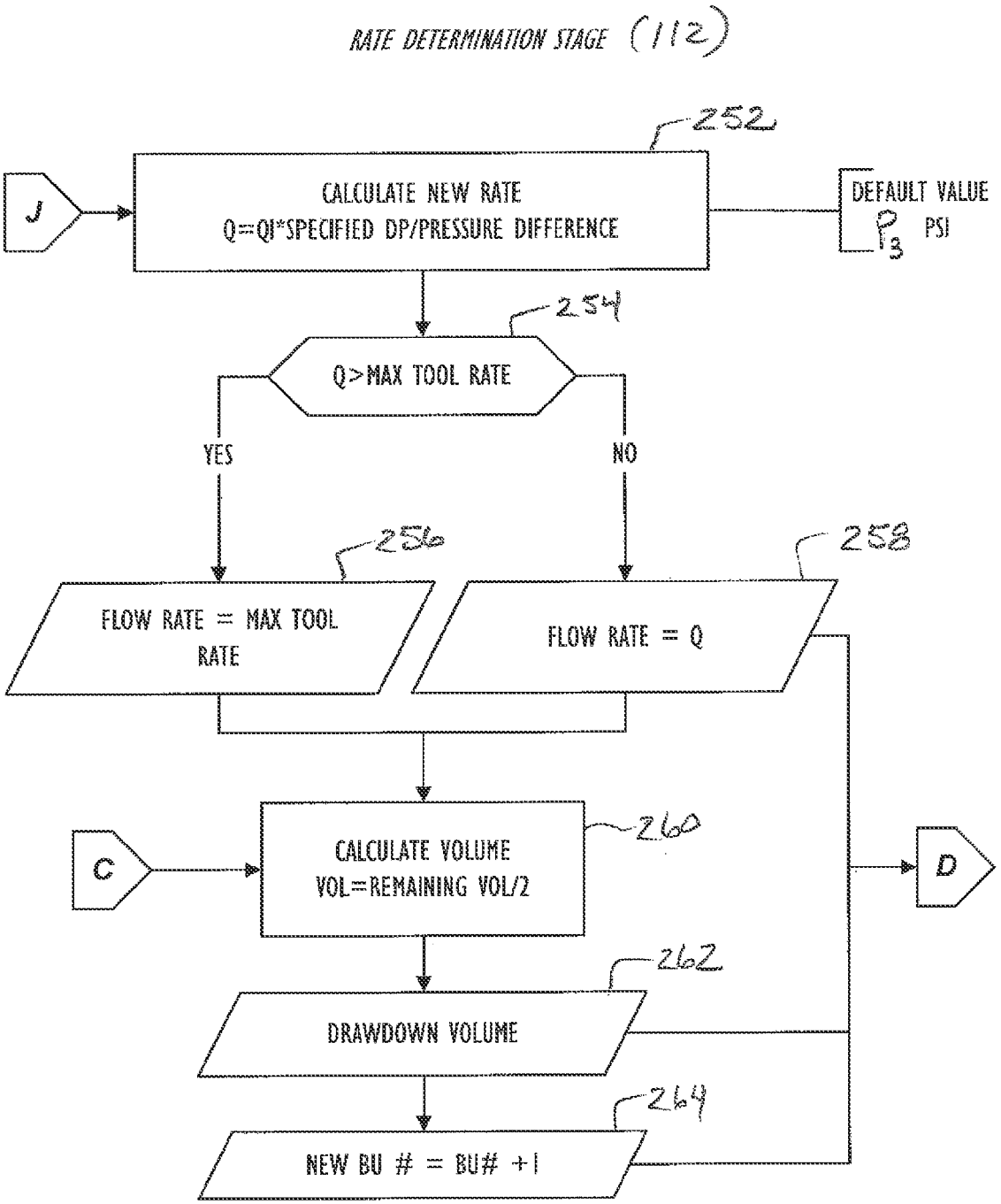
FIG. 8 shows details of the rate determination stage of the disclosed process of FIG. 3.

Turning now to FIG. 8, the rate determination stage (112) is initiated from the second logic stage (110) via Link (J) if the final buildup pressure ($P_{STOP}$) of the current buildup is not equal to that of the previous buildup (Decision 228; FIG. 7) and if the number of buildup operations done is not greater than three (Decision 230; FIG. 7). In general, this may indicate that the pre-test is "tight" (i.e., has a thin pressure differential) so that the flow rate and volume for the drawdown needs to be redefined. In the end, the goal of the rate determination stage (112) then is to determine new parameters for conducting a subsequent pre-test operation of the subject borehole location.

As shown in FIG. 8, the rate determination stage (112) at Block 252 calculates a new pre-test flow rate as follows:

$$Q = qi * \frac{\text{Specified_dP}}{\text{Pressure_Difference}}$$

Here, the new flow rate is based on the previous flow rate scaled by a ratio of a specified pressure differential relative to the pressure difference between the final build up pressure and the final drawdown pressure. The intention is to create a flow rate with a preferred or useful pressure differential $P_3$. This newly calculated flow rate Q may actually exceed the maximum flow rate of the tool 10 (Decision 254) so that the rate determination stage sets the new flow rate accordingly (Blocks 256, 258). By calculating a new rate, the testing sequence works to minimize the pressure drawdown thereby minimizing the amount of time required for a successful build up period within the time permitted.

Either way, a new drawdown volume is calculated from the remaining volume in the drawdown chamber (60) indicated by what the piston (62) had previously moved (Decision 260). In other words, a remaining volume is obtained from the piston volume moved 158 during the drawdown stage (104) via Link (C), and a new volume is calculated as at least half that remaining volume. Using this new volume, the stage (112) determines the new drawdown volume 262. For example, if the first pre-test run had a drawdown volume of 5-cc of the total available volume of 40-cc, then a volume of 35-cc remains. With the calculation, the new volume for the next drawdown would be half of that remaining volume or about 17.5-cc, provided the desired configuration consists of three drawdown and buildup sequences. In any event, during the second drawdown at this increased volume, the drawdown may still end before attaining that volume if the drawdown interval exceeds 30-seconds (i.e., the rate to fill this increased volume may not be enough to fill the entire increased volume within that time frame).

Additionally, the stage (112) increments the buildup count (Block 264) so that the process 100 will complete at most three runs (although more or less can be configured). In the end, the new flow rate 256 or 258, the new drawdown volume 262, and the incremented buildup count 264 are fed back as the drawdown parameters 142 of the drawdown stage (104) of FIG. 4 via Link (D) for the next drawdown operation. A subsequent drawdown operation on the same portion of the formation can then use these reconfigured parameters 142.

In addition, should communication be possible at some point, data of the pre-test could be telemetered uphole. By observing the data collected during a pre-test drawdown stage, an engineer may have the option to change the initial pre-test parameters, such as drawdown rate and drawdown volume, to better match them to the formation characteristics before attempting subsequent tests. Any reconfigured parameters 142 may even be used as initial conditions on another borehole location, or the pre-test process 100 may use a predefined set of initial conditions on the other borehole location with those initial conditions being either configured for the particular borehole location or not.

The subject matter of the present disclosure can be implemented in digital electronic circuitry, in computer hardware, firmware, software, or in combinations of these. For example, a computer program product tangibly embodied in a machine-readable or programmable storage device for execution by a programmable control device or processor can embody the disclosed subject matter, and method steps of the present disclosure can be performed by the programmable processor executing a program of instructions to perform functions disclosed herein. Any suitable processors can be used including general and special purpose microprocessors. Generally, a processor will receive instructions and data from a read-only memory and/or a random access memory. Generally, any memory or storage devices can include magnetic disks, such as internal hard disks and removable disks; magneto-optical disks; optical disks; non-volatile memory; and semiconductor memory devices (such as EPROM, EEPROM, and flash memory devices)—some of which may be better suited for downhole use. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A programmable storage device having program instructions stored thereon for causing a programmable control device to perform a formation pressure test method, comprising:

preconfiguring a formation tester to test each of one or more stations of a formation with at least two autonomous drawdowns and buildups;

obtaining a first drawdown pressure by performing a first of the autonomous drawdowns toward a first preconfigured volume of a total available volume with a first preconfigured flow rate at one of the stations;

obtaining a first buildup pressure by performing a first of the autonomous buildups at the one station;

determining a second volume as a fraction of the total available volume remaining from an actual volume used in the first drawdown;

determining a second flow rate from the first preconfigured flow rate scaled by a ratio based on a difference between the first buildup pressure and the first drawdown pressure;

performing a second of the autonomous drawdowns toward the second volume with the second flow rate at the one station;

obtaining a second buildup pressure by performing a second of the autonomous buildups at the one station after success of the second autonomous drawdown;

comparing the first buildup pressure measured in the first autonomous buildup to the second buildup pressure measured in the second autonomous buildup; and proceeding with operation of the formation tester based on the comparison.

2. The programmable storage device of claim 1, wherein the at least two autonomous drawdowns and buildups are performed independent of communications with surface equipment.

3. The programmable storage device of claim 1, wherein proceeding with operation of the formation tester based on the comparison comprises terminating the formation testing at the one station if the first and second buildup pressures are equivalent.

4. The programmable storage device of claim 1, wherein the second flow rate is determined based on the first flow rate scaled by the ratio of a specified pressure differential relative to the difference between the first buildup pressure and the first drawdown pressure.

5. The programmable storage device of claim 1, wherein performing the first or second autonomous drawdown comprises:

drawing down on the one station with the formation tester toward the first or second volume with the first or second flow rate; and determining whether the first or second drawdown meets at least one drawdown criterion.

6. The programmable storage device of claim 5, wherein performing the first or second autonomous buildup comprises:

measuring the first or second buildup pressure in the first or second autonomous buildup if the first or second autonomous drawdown meets the at least one drawdown criterion; and determining whether the first or second autonomous buildup meets at least one buildup criterion.

7. The programmable storage device of claim 1, wherein proceeding with operation of the formation tester based on the comparison comprises performing a third autonomous drawdown and a third autonomous buildup if the second buildup pressure is different from the first buildup pressure.

8. The programmable storage device of claim 7, wherein performing the third autonomous drawdown comprises:

determining a third flow rate and a third volume, the third flow rate determined based on a difference between the second buildup pressure and a second drawdown pressure measured in the second drawdown;

drawing down on the formation with the formation tester toward the third volume with the third flow rate; and determining whether the third drawdown meets at least one drawdown criterion.

9. The programmable storage device of claim 7, wherein performing the third autonomous buildup comprises:

measuring a third buildup pressure if the third autonomous drawdown meets at least one drawdown criterion.

10. The programmable storage device of claim 1, wherein performing the first or second autonomous drawdown comprises determining that the first or second autonomous drawdown meets at least one drawdown criterion.

11. The programmable storage device of claim 10, wherein determining that the first or second autonomous drawdown meets the at least one drawdown criterion comprises determining that the first or second autonomous drawdown exceeds a minimum time interval and reaches a minimum volume.

12. The programmable storage device of claim 10, wherein determining that the first autonomous drawdown meets the at least one drawdown criterion comprises:

calculating a bubble point pressure for the formation at the one station; and determining that the first drawdown pressure exceeds the calculated bubble point pressure.

13. The programmable storage device of claim 10, wherein determining that the first autonomous drawdown meets the at least one drawdown criterion comprises determining that a difference between a hydrostatic pressure and the first drawdown pressure indicates a seal of the formation tester with the formation.

14. The programmable storage device of claim 10, wherein determining that the first autonomous drawdown meets the at least one drawdown criterion comprises determining that the formation tester has reached a minimum setting pressure at the one station.

15. The programmable storage device of claim 1, wherein performing the first or second autonomous buildup comprises determining that the first or second autonomous buildup meets at least one buildup criterion.

16. The programmable storage device of claim 15, wherein determining that the first or second autonomous buildup meets the at least one buildup criterion comprises determining that a rate of pressure buildup falls below a predetermined rate.

17. The programmable storage device of claim 15, wherein determining that the first autonomous buildup meets the at least one buildup criterion comprises determining that a difference between the first buildup pressure and the first drawdown pressure measured in the first autonomous drawdown at least exceeds a predetermined threshold.

18. The programmable storage device of claim 15, wherein determining that the first or second autonomous buildup meets the at least one buildup criterion comprises determining that an elapsed time interval for the first or second autonomous buildup does not exceed a predetermined time interval.

19. An autonomous formation pressure testing method, comprising:

preconfiguring a formation tester to test each of one or more stations of a formation with at least two autonomous drawdowns and buildups;

obtaining a first drawdown pressure by performing a first of the autonomous drawdowns toward a first preconfigured volume of a total available volume with a first preconfigured flow rate at one of the stations;

obtaining a first buildup pressure by performing a first of the autonomous buildups at the one station;

determining a second volume as a fraction of the total available volume remaining from an actual volume used in the first drawdown;

determining a second flow rate from the first preconfigured flow rate scaled by a ratio based on a difference between the first buildup pressure and the first drawdown pressure;

performing a second of the autonomous drawdowns toward the second volume with the second flow rate at the one station;

obtaining a second buildup pressure by performing a second of the autonomous buildups at the one station after success of the second autonomous drawdown;

comparing the first buildup pressure measured in the first autonomous buildup to the second buildup pressure measured in the second autonomous buildup; and proceeding with operation of the formation tester based on the comparison.

20. The method of claim 19, wherein the at least two autonomous drawdowns and buildups are performed independent of communications with surface equipment.

21. The method of claim 19, wherein proceeding with operation of the formation tester based on the comparison comprises terminating the formation testing at the one station if the first and second buildup pressures are equivalent.

22. The method of claim 19, wherein the second flow rate is determined based on the first flow rate scaled by the ratio of a specified pressure differential relative to the difference between the first buildup pressure and the first drawdown pressure.

23. The method of claim 19, wherein performing the first or second autonomous drawdown comprises:

drawing down on the one station with the formation tester toward the first or second volume with the first or second flow rate; and determining whether the first or second drawdown meets at least one drawdown criterion.

24. The method of claim 23, wherein performing the first or second autonomous buildup comprises:

measuring the first or second buildup pressure in the first or second autonomous buildup if the first or second autonomous drawdown meets the at least one drawdown criterion; and determining whether the first or second autonomous buildup meets at least one buildup criterion.

25. The method of claim 19, wherein proceeding with operation of the formation tester based on the comparison comprises performing a third autonomous drawdown and a third autonomous buildup if the second buildup pressure is different from the first buildup pressure.

26. The method of claim 25, wherein performing the third autonomous drawdown comprises:

determining a third flow rate and a third volume, the third flow rate determined based on a difference between the second buildup pressure and a second drawdown pressure measured in the second drawdown;

drawing down on the formation with the formation tester toward the third volume with the third flow rate; and determining whether the third drawdown meets at least one drawdown criterion.

27. The method of claim 25, wherein performing the third autonomous buildup comprises:

measuring a third buildup pressure if the third autonomous drawdown meets the at least one drawdown criterion.

28. The method of claim 19, wherein performing the first or second autonomous drawdown comprises determining that the first or second autonomous drawdown meets at least one drawdown criterion.

29. The method of claim 28, wherein determining that the first or second autonomous drawdown meets the at least one drawdown criterion comprises determining that the first or second autonomous drawdown exceeds a minimum time interval and reaches a minimum volume.

30. The method of claim 28, wherein determining that the first autonomous drawdown meets the at least one drawdown criterion comprises:

calculating a bubble point pressure for the formation at the one station; and determining that the first drawdown pressure exceeds the calculated bubble point pressure.

31. The method of claim 28, wherein determining that the first autonomous drawdown meets the at least one drawdown criterion comprises determining that a difference between a hydrostatic pressure and the first drawdown pressure indicates a seal of the formation tester with the formation.

32. The method of claim 28, wherein determining that the first autonomous drawdown meets the at least one drawdown criterion comprises determining that the formation tester has reached a minimum setting pressure at the one station.

33. The method of claim 19, wherein performing the first or second autonomous buildup comprises determining that the first or second autonomous buildup meets at least one buildup criterion.

34. The method of claim 33, wherein determining that the first or second autonomous buildup meets the at least one buildup criterion comprises determining that a rate of pressure buildup falls below a predetermined rate.

35. The method of claim 33, wherein determining that the first autonomous buildup meets the at least one buildup criterion comprises determining that a difference between the first buildup pressure and the first drawdown pressure measured in the first autonomous drawdown at least exceeds a predetermined threshold.

36. The method of claim 33, wherein determining that the first or second autonomous buildup meets the at least one buildup criterion comprises determining that an elapsed time interval for the first or second autonomous buildup does not exceed a predetermined time interval.

* * * * *